United States Patent [19]

Anderson et al.

[11] 3,950,614

[45] Apr. 13, 1976

[54] REMOTE WRITING APPARATUS

[75] Inventors: Trevor James Anderson, Crowborough; Graham Laughton, Burgess Hill, both of England

[73] Assignee: Feedback Instruments Limited, Sussex, England

[22] Filed: Jan. 2, 1975

[21] Appl. No.: 538,238

[30] Foreign Application Priority Data

Jan. 11, 1974 United Kingdom ..... 01319/74

[52] U.S. Cl. ..... 178/18; 346/139 C

[51] Int. Cl.[2] ..... G08C 21/00

[58] Field of Search ..... 310/DIG. 6, 268; 178/18, 178/19, 20, 21; 33/1 M; 346/139 C

[56] References Cited

UNITED STATES PATENTS

| | | | |
|---|---|---|---|
| 2,686,099 | 8/1954 | Bomberger et al. | 33/1 M X |
| 2,935,561 | 5/1960 | Weingart et al. | 178/18 |
| 3,046,336 | 7/1962 | Leavitt et al. | 178/18 |
| 3,143,599 | 8/1964 | Mero | 178/18 |
| 3,453,388 | 7/1969 | Neville | 178/18 |
| 3,719,845 | 3/1973 | Takeda | 310/268 |

*Primary Examiner*—Thomas A. Robinson
*Attorney, Agent, or Firm*—Dowell & Dowell

[57] ABSTRACT

The invention relates to a writing system having a receiver in which a pen is moved over paper in response to signals received. The pen is driven by a pair of high torque, fast response servo motors having printed armatures, enabling the use of a ball point pen. The pen is connected to linkages carried by a pivotal cradle, the pivoting of which effects movement of the pen towards and away from the paper. The invention also embodies a transceiver and a transmitter of the writing system. The cradle is laterally fixed in offset relationship with respect to the writing area, and the motors are also mounted in fixed position to reduce inertia of the moving parts.

7 Claims, 9 Drawing Figures

REMOTE WRITING APPARATUS

BACKGROUND TO THE INVENTION

This invention relates to a writing system, more particularly one in which written information is converted into electrical signals for transmission to a remotely positioned receiver where the original written information is faithfully reproduced. The transmission may take place over conventional telephone exchange lines or other media such as direct two-wire connection, dedicated Post Office lines, radio links in conjunction with a radio transmitter and receiver, modulated light links in conjunction with suitable transmission apparatus, acoustic couplers, and the received signals used to control the movement of a pen over a pad.

Such systems are already well known and form the subject of British Pat. Nos. 809,209 (Telautograph Corporation) and 897,876 (P.G.S. Mero trading as Electrowriter Company).

An object of the invention is to improve the speed of response over known apparatus so that the operator can write at his normal speed without impairing reproduction, i.e. the time delay between writing and reproduction is negligible. A further object of the invention is to achieve a more positive drive whereby conventional ball point pens can be used with the receiver thus achieving lower operational costs, and whereby good accuracy in reproduction can be obtained.

SUMMARY OF THE INVENTION

According to one feature of the invention we provide writing apparatus comprising a housing, a writing area defined within the housing, a stylus support above the writing area, two servo motors mounted on the housing and a linkage connecting each said servo motor to the stylus support, whereby the linkages move the stylus support within the writing area according to signals received by said servo motors, said servo motors being of the type having printed armatures and sufficiently high torque characteristics to permit fast response of movement of said stylus support.

Preferably, there is provided within the housing a cradle pivotally mounted about a horizontal axis, the cradle carrying said linkages. Means for pivoting the cradle, preferably in the form of a solenoid, are provided.

The linkages preferably each comprise a pair of articulated arms, both connected at one of their ends to the stylus support, and each connected at their other ends to one of two shafts carried on the cradle. The shafts carry pulleys which are driven by flexible drive belts from the servo motors. The use of flexible drive belts enables pivoting of the cradle for movement of the stylus support towards and away from the writing area, while the servo motors are fixedly mounted.

According to a second feature of the invention we provide writing apparatus comprising a housing, a writing area defined within the housing, a stylus support above the writing area, a cradle within the housing, pivotally mounted about a horizontal axis, a pair of potentiometers carried on said cradle, a shaft associated with each potentiometer, a linkage connecting each said shaft to the stylus support whereby said linkages operate said potentiometers in response to movement of said stylus support within said writing area, means for detecting pivotal movement of said cradle, and electrical circuit means electrically connected to said potentiometers and to said means for detecting pivotal movement to produce output signals in response to movement of said stylus support within, and towards and away from said writing area.

In a preferred embodiment of the invention, by circuitry which is known and not forming part of the present invention, the d.c. voltages from the potentiometers are converted to frequency modulated signals and these together with pen-lift signals are applied through a line transformer to telephone lines. Logic circuitry in the transmitter controls line acquisition, paper feed and indicator lamps.

In operation the servo motors receive varying d.c. voltages which are produced from converted frequency modulated signals transmitted over telephone lines from the transmitter. The servo motors drive via the belts and pulleys, the linkages to the same angular positions as those of the transmitter linkages. Pen-lift signals cause operation of the solenoid. Logic circuits control the signal acceptance, paper feed and indicator lamps etc.

In comparison with other known systems which perform a similar function the present invention provides the following advantages:

Servo Motors

The use of printed armature motors enables the pens to be driven with a direct drive and not through gearing as is conventional. These motors give an unusually fast response and hence there is no restriction on the speed of writing. Therefore a more positive drive is obtained which allows the use of a normal ball point pen with its relatively high writing friction rather than capillary or felt-tip pens. Furthermore, there is sufficient pen pressure to produce several carbon copies if required.

Pen Drive Linkage

By providing the pivoted cradle to support the linkages the pen can be raised and lowered by a solenoid. Pen lift operation is therefore accomplished without the use of a striker bar on the pen linkage and without having to lift the whole motor and pen linkage assembly.

Pen Lift Signals

If the transmitter writing surface or platen supporting the paper is spring loaded but capable of small movements in a direction normal to the surface, when the pen is brought into contact with the writing surface, normal writing force on the pen is sufficient to move the platen and actuate contact devices causing 'pen-down' signals to be transmitted. Trailing leads on the pen body are thus avoided.

Stylus

It is not necessary to use a special pen on either transmitter or receiver; standard ball-point refills can be used.

BRIEF DESCRIPTION OF THE DRAWINGS

The invention will now be described by way of example with reference to the accompanying drawings in which.

Figure 1:
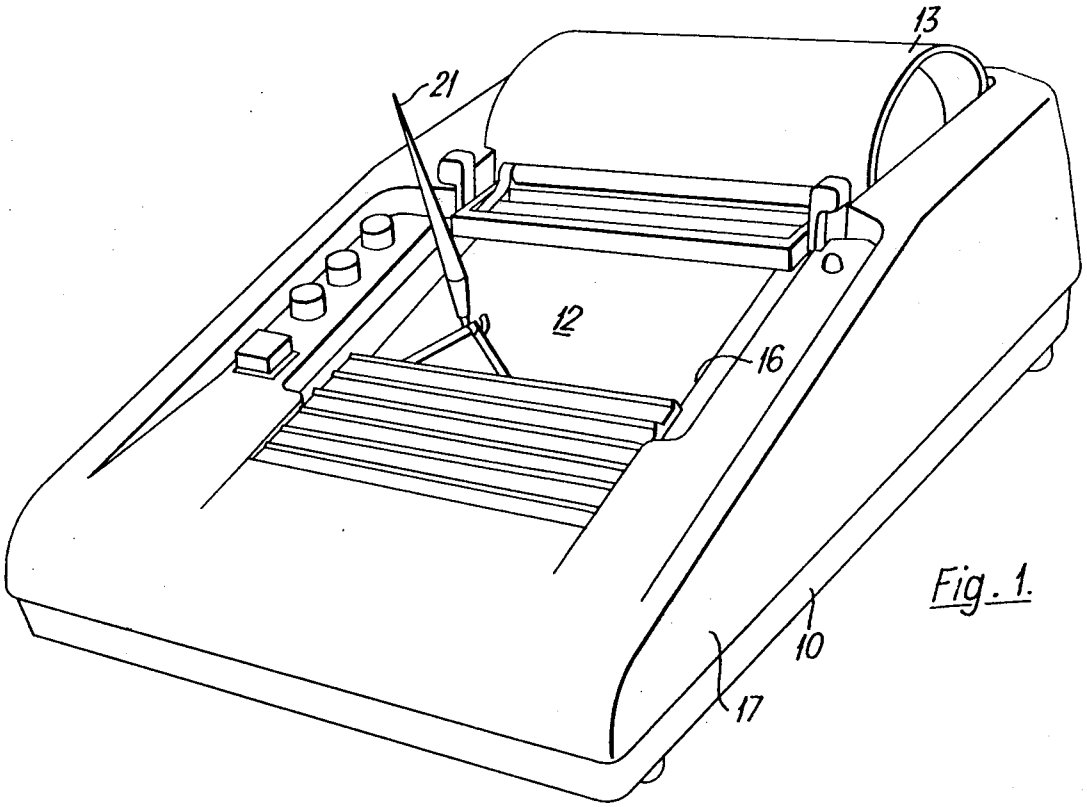
FIG. 1 is a perspective view of a writing apparatus receiver according to the invention.
Figure 2:
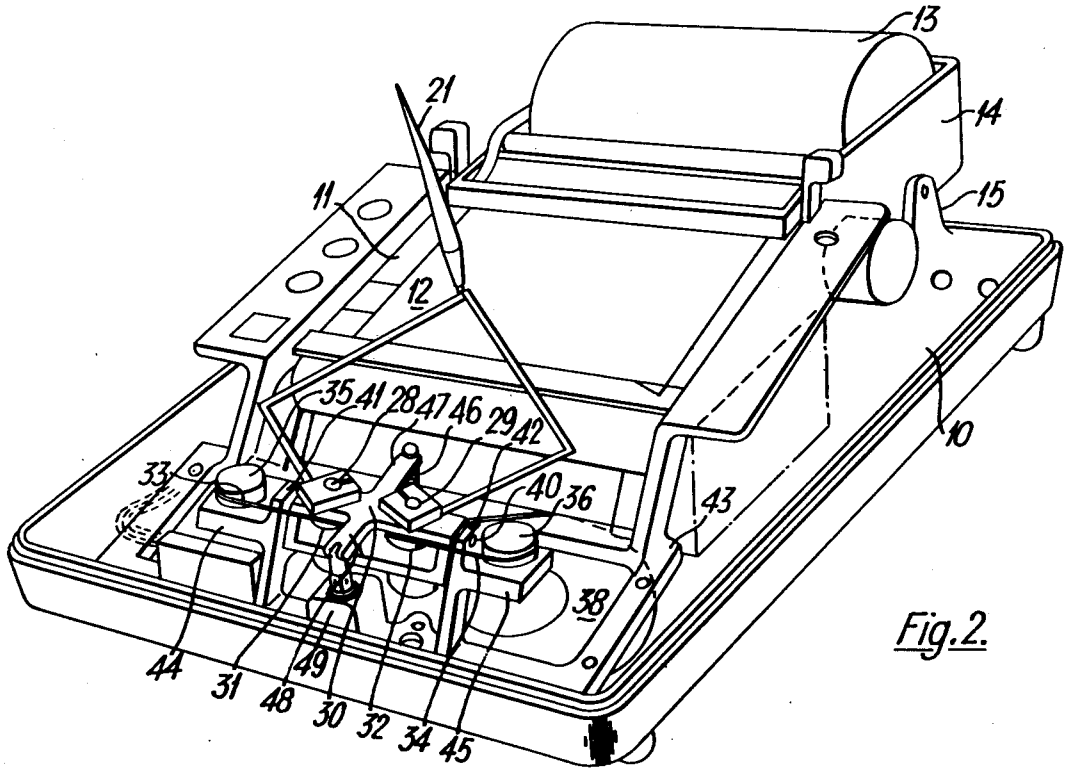
FIG. 2 is a similar perspective view of the receiver shown in FIG. 1 with the casing omitted, certain components and details also being omitted for clarity.
Figure 3:
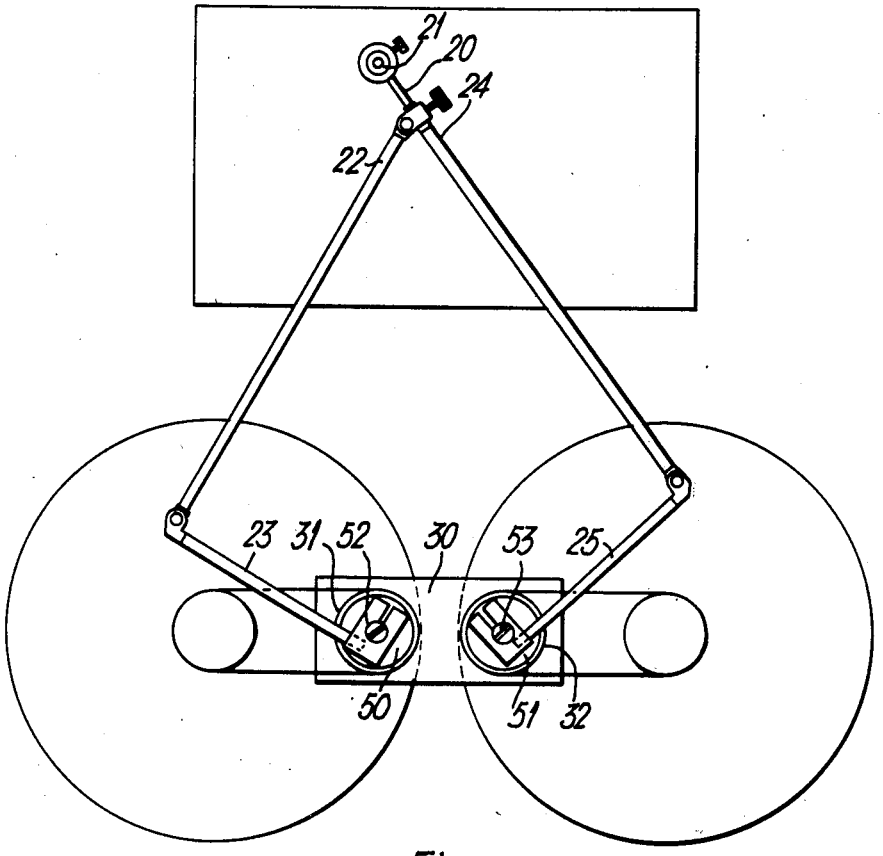
FIG. 3 is a schematic plan view of a transceiver showing the linkage system connected to the stylus support and the drive mechanism therefor.
Figures 4, 5:
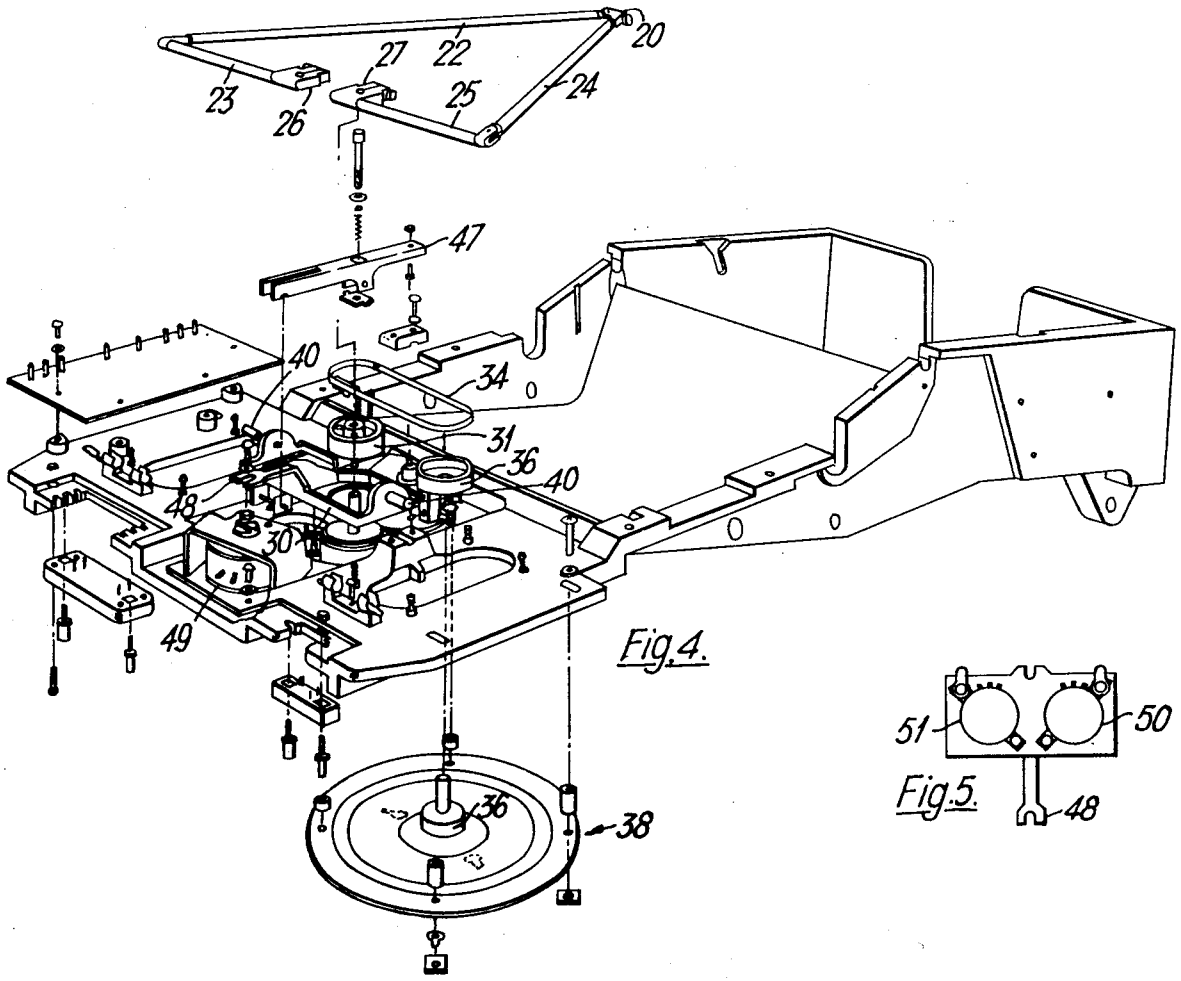
FIG. 4 is an exploded view of the cradle assembly of a transceiver assembly according to the invention.
FIG. 5 is a view of the potentiometer cradle of the apparatus shown in FIG. 4 from the underside.

The receiver shown in FIGS. 1 and 2 and the transceiver shown in FIGS. 3, 4 and 5 are part of a remote writing system and each comprise a base 10 of dimensions 11.22 inches by 16.61 inches on which there is mounted a pad support 11 over which a strip of paper 12 passes from a roll 13 supported in a receptacle 14 which is mounted at the rear of the base on lugs 15. The pad is exposed through a window 16 formed in the casing 17. A motorised transport mechanism (not shown) is provided for drawing the paper off the roll and across the pad support. Such mechanism is known and is not further described. The transport mechanism can be actuated to move the paper intermittently as each area appearing in the window becomes used.

A stylus support 20, which may be a screw clamp, to hold a ball point pen 21 is carried on a pair of articulated arms, the longer arms 22, 24 of which are 5½ inches in length, and the shorter arms 23, 25 of which are 2¾ inches in length. The ends of the linkages are attached by clamps 26, 27 to the shafts 28, 29 mounted vertically in a cradle 30 and which carry 1 inch diameter pulleys 31, 32 at their lower ends driven by belts 33, 34 via two further pulleys 35, 36 of similar size on the end of the shafts of servo motors 37, 38. The two pairs of pulleys are of the same diameter to achieve a 1:1 transmission between the servo motors and the linkages.

The servo motors are of the kind having printed armatures which give the advantage of a fast response compared with hitherto used motors in automatic writing devices. Also these motors provide greater torque than conventional motors of the same depth. The printed motors are "pan cake" shaped so that a height reduction of the equipment is achieved.

The servo motors 37, 38 are of the type GPM 9M4 manufactured by Printed Motors Limited. They are 12 volt DC motors taking a maximum current of 5 amps.

The cradle is pivotably mounted on pins 40 between upstanding lugs 41, 42 formed integrally with a moulded chassis 43 secured to the base 10. The lugs are shaped to include horizontally extending platforms 44, 45 which provide bearings for the shafts of the servo motors.

The cradle is biased into a pen engaging position by a spring 46 connected between a lug 47 and the chassis 43. A further lug 48 in the cradle opposed to lug 47, is connected to a solenoid 49 which when actuated lifts the pen from the paper 12. The dimensions of the cradle are 3 inches by 1½ inches in plan view.

The transceiver shown in FIGS. 3, 4 and 5 is constructed in a similar manner to the receiver shown in FIGS. 1 and 2 to include a stylus support 20 mounted on linkages 22, 23 and 24, 25, and the pivoted cradle 30. In the transceiver, however, the ends of the linkages are connected by clamps 26, 27 to the shafts of potentiometers 50, 51. Accordingly every pen position on the writing surface is directly related to the two potentiometer shaft angles. The pad support is spring-loaded and capable of small movements in a direction normal to its surface and a platen switch (not shown) is disposed beneath the pad support so that pen-down or pen-lift signals are emitted by the transceiver when the pen is disengaged from the pad.

The transceiver contains all the components required for transmitter or receiver operation. Transceiver logic circuits switch the instrument into the required mode as selected by the operator.

Figure 6:
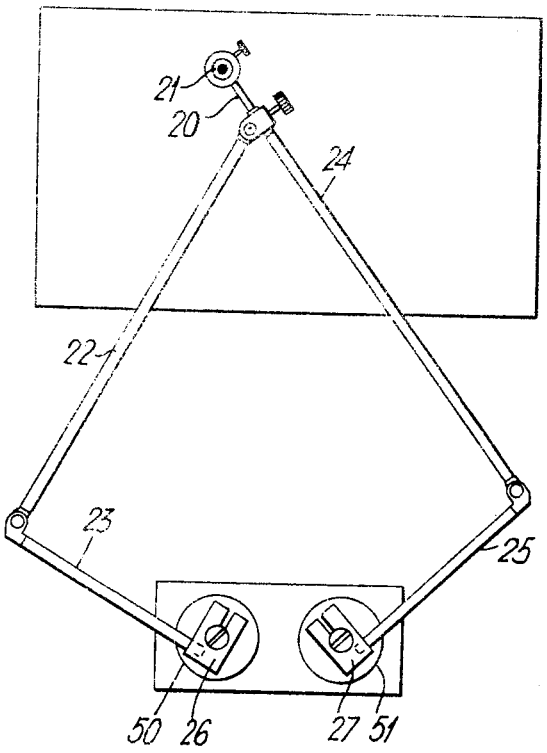
FIG. 6 is a schematic plan view of a transmitter showing a linkage system connected to the shafts of potentiometers producing signals for transmission to the receiver.

FIG. 6 shows a transmitter having potentiometers 50, 51 mounted on the cradle 30; the shafts 52, 53 of the potentiometers are coupled with the pulleys 31, 32 and the linkages.

Figure 7A:
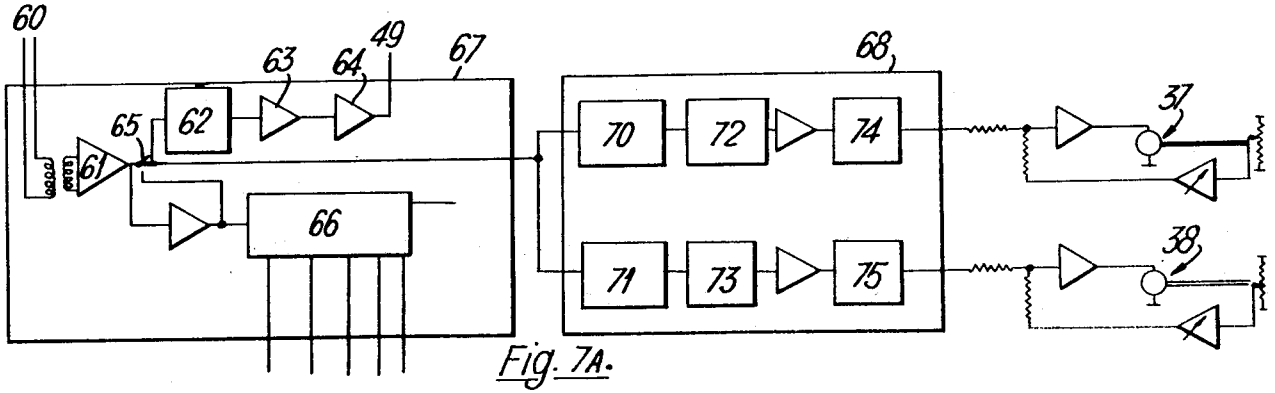
FIGS. 7A, 7B, and 7C are respectively circuitry for a receiver, transmitter, and transceiver of writing apparatus according to the invention.

Referring to FIG. 7A, the receiver signals appearing on the line 60 from a transmitter are received by amplifier 61 and are connected via a switch 65 logic block 67 to a frequency to voltage converter 68 which separates out the right and left channel signals by band-pass filters 70, 71 and converts then to voltages by phased locked loops 72, 73 and low-pass 50 Hz filters 74, 75 to drive the pen linkages via the servo motors 37, 38.

A third band-pass filter 62 in the logic block 67 converts the pen down/up signals from the transmitter via a phase locked loop 63 and comparator 64 into a signal to drive the pen-lift solenoid 49 to raise and lower the receiver pen in synchronism with the transmitter pen.

A logic circuit 66 within the logic block has a number of outputs the purposes of which are as follows.

A gain output of the logic circuit 66 is used to activate or quench the servo amplifiers. This facility is particularly used when the receiver pen is in a "park" position and there are no signals on the line 60. Otherwise the phase locked loops 72, 73 which need a synchronizing input and are always searching for one, would cause the servo motors to drive the pen at random when no signal was on the line. Other outputs of the logic circuit 66 are all concerned with feeding paper through the machine and are described in further detail below in connection with the transmitter shown in FIG. 7B, except that the paper feed operations are initiated when the pen is driven to appropriate places on the writing area instead of being placed there by hand, as in the transmitter.

Figure 7C:
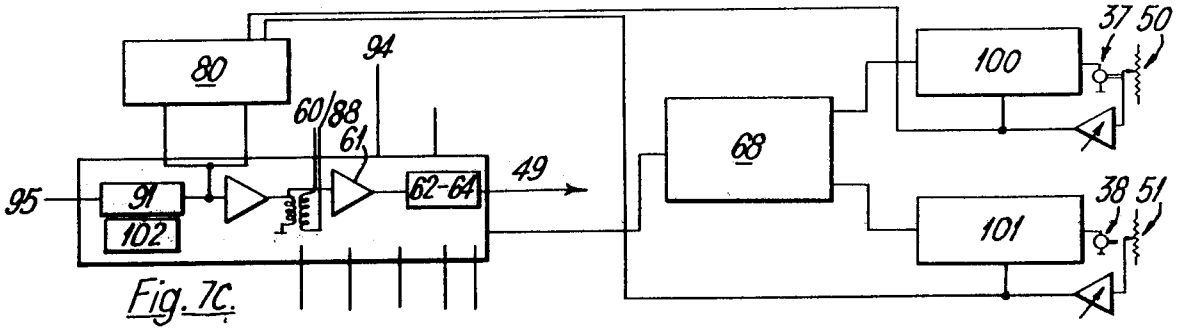
Figure 7B:
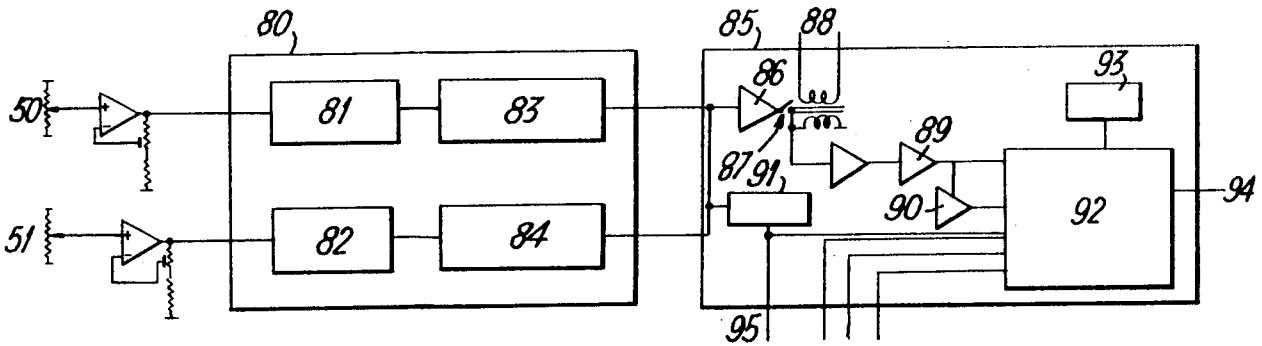

Referring now to FIG. 7B, in the transmitter, the left and right channel potentiometers 50, 51, driven by the pen linkage, produce varying voltages which are converted to frequency variations by the voltage to frequency converter 80, which includes 1730 Hz and 2750 Hz fixed frequency oscillators 81, 82 and band-pass filters 83, 84 which remove any frequency components which might violate Post Office regulations when Post Office lines are used. The outputs of the voltage to frequency converter pass to a logic block 85 including an amplifier 86.

In the logic block 85 the switch 87 operates under control of the logic circuit 92. When the sender wishes to transmit he takes the pen from its "park" position, generating thereby a pen-park signal to the logic circuit 92. If, at this time, another transmitter connected to the line 88 (secondary of the transformer) is generating signals, these are detected by a x20 amplifier and comparator 89 and used by the logic circuit 92 to light a "wait" lamp 94 and to maintain the switch 87 in an open position. Thus the transmitter cannot send and the operator is warned that another machine is using the line. A delay block 90 ensures that the switch 87 remains open a predetermined time after the line is cleared.

If and when the line is not in use, the "pen-park" signal closes the switch 87 via the logic circuit 92 and thus applies signals to the line 88, incidentally locking out any other transmitters on the network.

A platen switch signal 95 is generated by the platen switch (not shown) which operates every time the pen is put to the paper and causes an oscillator 91 to shift in frequency from 1050 to 1150 Hz. The signal is mixed with the pen position signal and fed to the line 88 to control the penlift mechanism of any receivers on the network.

Other inputs to the logic circuit 92 are all concerned with feeding paper through the machine. When the pen is placed in a particular position on the writing area it operates a switch (not shown) which generates a signal causing a 2 inch paper feed. A manually operable switch elsewhere on the machine also causes a 2 inch feed. A cam switch (not shown) is driven by the paper feed motor which in turn is controlled by a feed-relay output of the logic circuit 92. Thus, paper feed is initiated via the feed-relay signal and is terminated by a cam switch signal. When the pen is returned to its "park" position at the end of a message, a "pen-park" signal initiates a 4 inch paper feed and also opens the line switch 87 to remove signals from the line 88. The block 93 is a regulated voltage supply for the logic circuit 92.

Referring to FIG. 7C, in a transceiver, the circuitry is a combination of that described in detail in connection with FIGS. 7A and 7B, and like reference numbers refer to like features. A single logic circuit 102 is used to control the device, and the servo motors 37, 38 are provided with amplifiers 100, 101. A "transmit" switch, when manually operated, gives a signal to the logic circuit 102 and, provided the pen is in its "park" position, the transceiver becomes in all respects identical to a transmitter and all signals are as previously described. Otherwise the transceiver normally reverts to being a receiver and then behaves in all respects as described above for a receiver.

When acting as a receiver the pen is spring loaded onto the paper, but when acting as a transmitter, this loading must be removed, and this is achieved by a spring release solenoid controlled by an output of the logic circuit 102.

The transceiver is normally in the 'receive' mode and is put into the transmit mode by the operator. The absence of gearing between the drive motors and pen arm spindles and the low inertia of the printed motor armature makes it unnecessary to declutch the motors. Also, since the transmitter pen tip, pen arms and potentiometers are identical to those on the receiver it is only necessary to switch the motors off and take the potentiometer output to a different part of the electronic circuit to change the pen drive from receive to transmit. This simplifies the operating procedures and is more direct in use than other transceiver systems.

We claim:

1. Writing apparatus comprising:

a. a housing;

b. a writing area defined within the housing;

c. a stylus support above the writing area;

d. cradle means mounted in fixed location on the housing laterally offset from the writing area and supported so that it can tilt toward and away from said writing area;

e. linkage means extending from the cradle means to the stylus support, the linkage means being rotatably supported on the cradle means and overlying the writing area whereby the stylus support approaches the writing surface when the cradle means tilts toward the writing area and recedes therefrom when the cradle means tilts away from the writing area; and f. servo-system means fixed in position with respect to the housing and coupled with the linkage means where it is rotatably supported on the cradle means.

2. The writing apparatus as set forth in claim 1, wherein said housing supports horizontal pivot means, and said cradle means is supported on said pivot means for tilting thereabout toward and away from said writing area.

3. The writing apparatus as set forth in claim 1, including solenoid means mounted on the housing and coupled with said cradle means, and operative when energized to tilt the cradle means away from the writing area.

4. The writing apparatus as set forth in claim 1, wherein the linkage means comprises two articulated arms each having one end connected to the stylus support; two shafts rotatably supported in said cradle means; and the other end of each articulated arm being connected to one of said shafts.

5. The writing apparatus as set forth in claim 4, wherein said servo system means comprises two printed armature servo motors mounted on said housing adjacent said cradle means, and flexible belt drive means coupling each motor to one of said shafts.

6. The writing apparatus as set forth in claim 1, wherein said servo system means comprises two potentiometers mounted on said cradle means and comprising said shafts; the linkage means comprising two articulated arms each having one end connected to the stylus support and the other end connected to one of said shafts.

7. The writing apparatus as set forth in claim 6, further comprising means operative to detect tilting of said cradle means; and electrical circuit means connected to said potentiometers and to said tilt detecting means to produce signals representative of the rotational positions of said potentiometers and of the tilt of said cradle means.

* * * * *